US007866805B2

(12) United States Patent
Furukawa

(10) Patent No.: US 7,866,805 B2
(45) Date of Patent: Jan. 11, 2011

(54) INTRODUCING LIQUID FOR INK JET HEAD, INK JET HEAD, AND INK JET RECORDING APPARATUS

(75) Inventor: Noriaki Furukawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 739 days.

(21) Appl. No.: 11/812,522

(22) Filed: Jun. 19, 2007

(65) Prior Publication Data

US 2007/0291072 A1 Dec. 20, 2007

(30) Foreign Application Priority Data

Jun. 20, 2006 (JP) ..... 2006-170431

(51) Int. Cl.
*B41J 2/17* (2006.01)

(52) U.S. Cl. ..... 347/95; 347/84; 347/98; 347/100

(58) Field of Classification Search ..... 347/21, 347/95–100, 84
See application file for complete search history.

(56) References Cited

U.S. PATENT DOCUMENTS 6,062,390 A * 5/2000 Nakamura ..... 206/576
7,037,362 B2 * 5/2006 Honma et al. ..... 106/31.13
2003/0180451 A1 * 9/2003 Kodas et al. ..... 427/123
2004/0056918 A1 * 3/2004 Wang et al. ..... 347/21
2004/0070655 A1 * 4/2004 Aoi et al. ..... 347/100
2006/0071990 A1 * 4/2006 Hirakawa ..... 347/95
2007/0030301 A1 * 2/2007 Kato et al. ..... 347/21
2007/0035588 A1 * 2/2007 Umemura et al. ..... 347/65
2007/0035599 A1 * 2/2007 Satoh et al. ..... 347/100
2007/0035600 A1 * 2/2007 Satoh et al. ..... 347/100
2007/0058013 A1 * 3/2007 Yamazaki ..... 347/96
2007/0064046 A1 * 3/2007 Goto et al. ..... 347/29
2007/0103527 A1 * 5/2007 Satoh ..... 347/100

FOREIGN PATENT DOCUMENTS

JP 2000-094707 4/2000
JP 2000094707 A * 4/2000

* cited by examiner

*Primary Examiner*—Matthew Luu
*Assistant Examiner*—Rut Patel
(74) *Attorney, Agent, or Firm*—Clark & Brody

(57) ABSTRACT

An introducing liquid for an ink jet head in the invention is used to fill the ink jet head before introducing ink into the ink jet head. The introducing liquid has a surface tension satisfying the following equation (1), and a contact angle of not more than 25 degrees with respect to an ink passage member of the ink jet head to be applied. An ink jet head of the invention is to be filled with the introducing liquid.

$$6\text{mN/m}<(St_{10}-St_{1000})<16\text{mN/m} \quad (1)$$

where $St_{10}$ is a surface tension in a lifetime of 10 msec, and $St_{1000}$ is a surface tension in a lifetime of 1000 msec.

5 Claims, 3 Drawing Sheets

(a)

(b)

INTRODUCING LIQUID FOR INK JET HEAD, INK JET HEAD, AND INK JET RECORDING APPARATUS

Priority is claimed to Japanese Patent Application No. 2006-170431 filed on Jun. 20, 2006, the disclosure of which is incorporated by reference in its entirety.

BACKGROUND OF THE INVENTION

1. Field of the Invention

The present invention relates to an introducing liquid for an ink jet head used when ink is introduced into an ink jet head in an ink jet recording method, and to an ink jet head using the introducing liquid, and an ink jet recording apparatus using the ink jet head.

2. Description of Related Art

In an ink jet recording method, ink is ejected from an ink jet head to form ink drops, and part or all of these are adhered to a recording medium such as paper, thereby to make recording. The above ink jet recording method calls for ink which can perform stable ejection without causing any clogging in a nozzle part and an ink passage in the ink jet head, and which can make recording of sufficiently high density with a clear color tone.

Meanwhile, the ink jet head can be roughly divided into thermal type and piezo type. In a recording apparatus of continuous injection type, there is, for example, electrostatic type that controls ejected ink drops by electric field. Specifically, in the thermal type, ink is instantly heated by using a heater so as to generate bubbles, and the force produced at this time is used to eject ink drops. In the piezo type, a piezoelectric device is vibrated to apply force to ink, enabling ink drops to be ejected. As a technique of applying force to ink in the piezo type, there are a method of applying force to ink by a piezo that induces vertical vibration, and a method of applying force to ink by a piezo that induces flexural vibration. In these methods, the force exerted on the ink can be improved by stacking piezoelectric devices. For achieving high density and mass production in the abovementioned piezo type, it seems to be suitable to use a piezoelectric device that induces flexural vibration, and not to stack the same.

In order that the performance of ink can be exhibited sufficiently in the ink jet recording method, especially when using an inkjet head of the piezo type, it is necessary to minimize the loss of pressure wave generated by vibration, and efficiently transmit force to the nozzle part. That is, it is important to create the condition of being completely filled with ink, without leaving any bubbles within the ink jet head. If bubbles remain within the ink jet head, ejection force cannot be sufficiently transmitted to the ink. This causes ejection defects such as non-ejection and injection curve, and the performance required for inkjet recording might not be satisfied. Hence, the condition where the ink jet head is filled with the ink can be said to be important element that controls the performance of the ink jet recording.

One heretofore known method of filling an ink jet head with ink without leaving bubbles, it has been proposed to fill an ink jet head with an introducing liquid before introducing the ink into the ink jet head. The introducing liquid is not more than 2 mm in bubble height immediately after bubbling, and 0 mm in bubble height after five minutes according to Ross Miles method (refer to Japanese Unexamined Patent Application Publication No. 2000-94707). The introducing liquid contains water and a water-soluble organic solvent having surface activity and a lower volatility than water.

However, the ink jet head is made up of various members formed by different materials, and a level difference and minute spacing are present in the areas where these members are bonded to each other. Therefore, even if the abovementioned introducing liquid is introduced, bubbles might be left in an ink passage. As a result, it is difficult to completely remove the bubbles at the time of filling the ink jet head with ink.

SUMMARY OF THE INVENTION

A main advantage of the present invention is to provide an introducing liquid for an ink jet head enabling to suppress leaving bubbles within an ink passage, by which when ejecting ink in an ink jet recording method, any ejection defects can be prevented to ensure ejection stability, as well as an ink jet head and an ink jet recording apparatus.

The present inventors have made tremendous research effort to solve the abovementioned problems by improving the wettability of an introducing liquid when an ink jet head is filled with the introducing liquid, before introducing the ink into the ink jet head. As a result, they have discovered that although surface tension at a lifetime of not less than 1000 msec measured by Wilhelmi method has been generally marked as the measure of wettability, an introducing liquid in which a difference between the surface tension in a lifetime of 10 msec and the surface tension in a lifetime of 1000 msec is within a specific range can function effectively to suppress leaving bubbles within an ink passage. That is, the surface tension in a short surface lifetime has a large influence on the wettability in the ink passage and, if a difference between the surface tension in a lifetime of 10 msec and the surface tension in a lifetime of 1000 msec is within the scope of the invention, it is possible to introduce an introducing liquid without bringing bubbles into an ink passage. Therefore, bubbles don't remaining an ink passage when an introducing liquid is substituted for an ink, thereafter ejection defects can be prevented to ensure ejection stability. They have also discovered that it is important to use, depending on an ink passage member of an ink jet head applied, an introducing liquid having a contact angle of not more than 25 degrees with respect to the ink passage member, in order that the bubbles don't remain in the ink passage member. Thus, the present invention has been made based on the fact that an introducing liquid satisfying these requirements can solve the abovementioned problems at a time.

An introducing liquid for an ink jet head according to the invention is used to fill the ink jet head before introducing ink into the ink jet head. The introducing liquid has a surface tension satisfying the following equation (1), and a contact angle of not more than 25 degrees with respect to an ink passage member of the ink jet head to be applied.

$$6\ \text{mN/m} < (St_{10} - St_{1000}) < 16\ \text{mN/m} \quad (1)$$

where $St_{10}$ is a surface tension in a lifetime of 10 msec, and $St_{1000}$ is a surface tension in a lifetime of 1000 msec.

Preferably, the introducing liquid for an ink jet head is composed of water, a surface active agent, and a water-soluble organic solvent. The water-soluble organic solvent contains at least either of diol having a carbon number of 6 to 8, and polyhydric alcohol alkyl ether having an organic value (OV) of not less than 150.

Preferably, the ink passage member is formed of at least one selected from the group consisting of epoxy resin, stainless steel, nickel alloy, polyimide resin, polycarbonate resin, and silicone resin.

An ink jet recording apparatus according to the invention is preferably provided with an ink jet head filled with the abovementioned introducing liquid.

A method of introducing ink into an ink jet head according to the invention includes: the step of filling an ink passage of the ink jet head with the abovementioned introducing liquid; and the step of replacing the introducing liquid within the ink passage with ink.

An ink jet recording method according to the invention includes: the step of filling an ink passage of the ink jet head with the abovementioned introducing liquid; the step of replacing the introducing liquid within the ink passage with ink; and the step of ejecting the ink from a nozzle to a surface of a recording medium.

In accordance with the present invention, when ejecting ink in an ink jet recording method, ejection defects can be prevented to ensure ejection stability.

Other objects and advantages of the present invention will become more apparent from the following detailed description of the present invention when taken in conjunction with the accompanying drawings.

DESCRIPTION OF PREFERRED EMBODIMENTS

Figure 1:
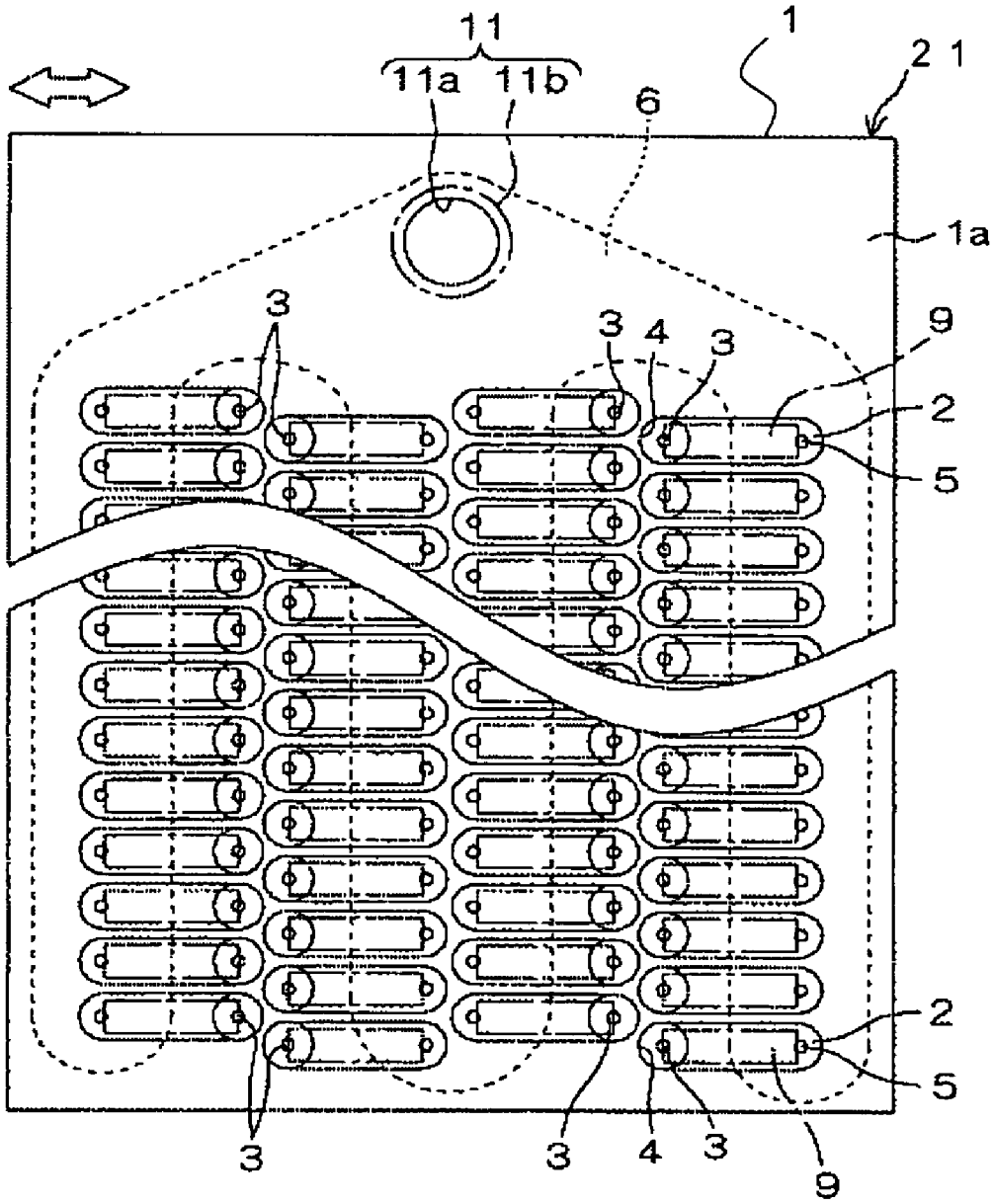
FIG. 1 is a plan view showing an example of a preferred embodiment of an ink jet head according to the present invention.

An introducing liquid for an ink jet head of the invention (hereinafter referred to simply as "an introducing liquid of the invention) is used to fill an ink jet head before ink is introduced into the ink jet head. That is, the introducing liquid of the invention is used to fill the ink jet head before introducing ink into the ink jet head, and then the ink is introduced into the ink jet head so that the introducing liquid can be replaced with the ink. This enables to introduce the ink without leaving bubbles within the ink jet head. As a result, no ejection defect occurs, and the ink can be ejected with excellent ejection stability.

No special limitation is imposed on the method of replacing the introducing liquid of the invention within an ink jet head with ink, the following methods can be employed. For example, in a state where an ink cartridge containing ink is connected to an ink jet head, an ejection port of the ink jet head is covered with a cap, and the ink is sucked by a pump, or the ink is transported by using a pump, or the ink is extruded and transported by air-pressing the cartridge or a sub-tank.

That is, a method of introducing ink into an ink jet head according to the invention is for introducing ink into an ink jet head by filling an ink passage of the ink jet head with an introducing liquid, and then replacing the introducing liquid within the ink passage with the ink.

It is important for the introducing liquid of the invention to have a surface tension satisfying the following equation (1):

$$6\ \text{mN/m} < (St_{10} - St_{1000}) < 16\ \text{mN/m} \quad (1)$$

Preferably, it has a surface tension satisfying the following equation (2):

$$6\ \text{mN/m} < (St_{10} - St_{1000}) < 12\ \text{mN/m} \quad (2)$$

Provided that $St_{10}$ and $St_{1000}$ are as defined above. When the value of $(St_{10}-St_{1000})$ is not less than 16 mN/m, sufficient wettability cannot be obtained, and the bubbles within the ink passage cannot be suppressed remaining in an ink passage. On the other hand, an introducing liquid used to fill an ink jet head for the purpose of the present application usually contains water and a water-soluble organic solvent. Therefore, by the solubility of the water-soluble organic solvent into water, it is substantially difficult to obtain an introducing liquid having a value of $(St_{10}-St_{1000})$ of not more than 6 mN/m when a surface active agent is added.

In the present invention, a surface tension relative to a surface lifetime, namely a surface tension in a lifetime of 10 msec and a surface tension in a lifetime of 1000 msec can be measured with a method of measuring a dynamic surface tension using a capillary, which is represented by bubble pressure method. Specifically, bubbles are generated from the capillary into the liquid, and the surface tension is measured from the pressure exerted on the bubbles, and the dynamic surface tension can be measured by changing a bubble frequency (for example, 0.01 to 10 Hz).

It is important for the introducing liquid of the invention that a contact angle with respect to an ink passage member of an ink jet head to be applied is not more than 25 degrees. Preferably, the contact angle with respect to the ink passage member is not more than 20 degrees. When the contact angle with respect to the ink passage member exceeds 25 degrees, sufficient wettability cannot be obtained, failing to suppress leaving the bubbles within the ink passage. In cases where the ink jet head is made up of a plurality of ink passage members formed of different materials, it is essential that the contact angles with respect to all of the ink passage members fall within the abovementioned range. In these cases, adhesive used to bond the respective materials is also one of the ink passage members.

In the present invention, the contact angles with respect to the ink passage members can be measured by using a contact angle meter (for example, "CA-X type" manufactured by Kyowa Interface Science Co., Ltd.).

Preferably, the introducing liquid of the invention includes, as essential compositions, water, a surface active agent, and a water-soluble organic solvent.

The water as an essential composition is preferably deionized water (pure water) . The content of water is preferably 65 to 95 weight % to the total weight of the introducing liquid.

Examples of the surface active agent as an essential composition are cationic surface active agent, anion surface active agent, amphoteric surface active agent, and nonionic surface active agent. Among others, anion surface active agent or nonionic surface active agent is preferred. The content of the surface active agent is preferably 0.1 to 5.0 weight % to the total weight of the introducing liquid. One type or two or more types of surface active agents may be used.

The water-soluble organic solvent as an essential composition preferably contains at least either of diol having a carbon number of 6 to 8, or polyhydric alcohol alkyl ether having an organic value (OV) of not less than 150 (hereinafter referred to as a "specific solvent composition" in some cases). The diol having a carbon number of 6 to 8 may have its hydroxyl group at any position, and the position of the hydroxyl group is effective in every combination. Examples of the polyhydric alcohol alkyl ethers are diethylene glycol monobutyl ether, triethylene glycol monobutyl ether, diplopylene glycol monobutyl ether, and triplopylene glycol monobutyl ether. Although no special limitation is imposed on the ratio of the specific solvent composition to the total weight of the introducing liquid, it is preferably 0.1 to 35 weight %. Alternatively, two or more types of the specific solvent compositions may be used. In this case, the ratio of the specific solvent composition to the total weight of the introducing liquid is preferably 0.1 to 35 weight %. Although the water-soluble organic solvent may contain solvent other than the specific solvent composition, it is desirable that the content of the other solvent falls within the abovementioned range.

The content of the water-soluble organic solvent as an essential composition is preferably 0.1 to 35 weight %, more preferably 0.5 to 25 weight %, to the total weight of the introducing liquid. When the content of the water-soluble organic solvent is below 0.1 weight %, it is often difficult to achieve a contact angle of not more than 25 degrees with respect to the ink passage member. Above 35 weight %, the viscosity of the introducing liquid is increased, and it might be difficult to introduce the introducing liquid itself.

The introducing liquid of the invention can contain as needed, besides the abovementioned essential compositions, various types of additives such as viscosity adjusting agent, pH adjusting agent, and preservative and antirust as long as these do not impair the effect of the present invention. Since a large amount of a coloring agent such as water-soluble dye tends to increase foamability, it is preferable not to use it. However, a small amount of the coloring agent for the purpose of visibility may be added as long as it does not impair the effect of the present invention.

In the present invention, the ink passage member is preferably formed of at least one selected from the group consisting of epoxy resin, stainless steel (SUS), nickel alloy, polyimide resin, polycarbonate resin, and silicone resin. In cases where the ink passage member is formed of one selected from the abovementioned group and the introducing liquid has a surface tension in the abovementioned range, the contact angle between the two can easily be not more than 25 degrees. Of course, the ink passage member in the present invention should not be limited to one selected from the abovementioned group.

Although no special limitation is imposed on an ink jet head to be filled with the introducing liquid of the invention, an ink jet head having 400 or more nozzles per head is suitable because it enables the effect of the invention to be exhibited more remarkably.

The ink jet head of the invention is preferably used with the aid of the abovementioned introducing liquid of the invention. The abovementioned introducing liquid is used to fill the ink jet head before introducing ink into the ink jet head, as described above. In the filling of the introducing liquid, as shown in FIG. 1, the introducing liquid is supplied to an ink jet head 21 through piping from an introducing liquid cartridge (not shown) and a joint part 11 for connecting this piping. A pump (not shown) is interposed between the cartridge and the joint part 11, so that the introducing liquid can be transported. As an example of the pump, a tube pump, a gear pump, or an electrodynamic pump can be used depending on the purpose.

In the ink jet head of the invention filled with the introducing liquid, the ejection side thereof (an ejection nozzle hole or the like) may be covered with a cap, and a gate of ink may be provided with a valve or a plug, in order to eliminate atmospheric communicating portions and prevent the leakage and evaporation of the introducing liquid. The ink jet head of the invention, which is filled with the introducing liquid, can be transported singly with the ink cartridge and the cap removed from the ink jet head. At that time, the ports connected to the ejection nozzle hole and the cartridge may be covered with an adhesive tape or a lid of rubber or the like, in order to suppress the leakage and evaporation of the introducing liquid.

FIG. 1 shows, as an example of the ink jet head of the invention, a state prior to attachment of a piezoelectric actuator including stacked piezoelectric devices 8 and individual electrodes 9. In an ink jet head 21 in the example of FIG. 1, a plurality of dot forming parts, each including a pressurized room 2 and a nozzle 3 communicating to the pressurized room 2, are arranged on a substrate 1.

Figure 2:
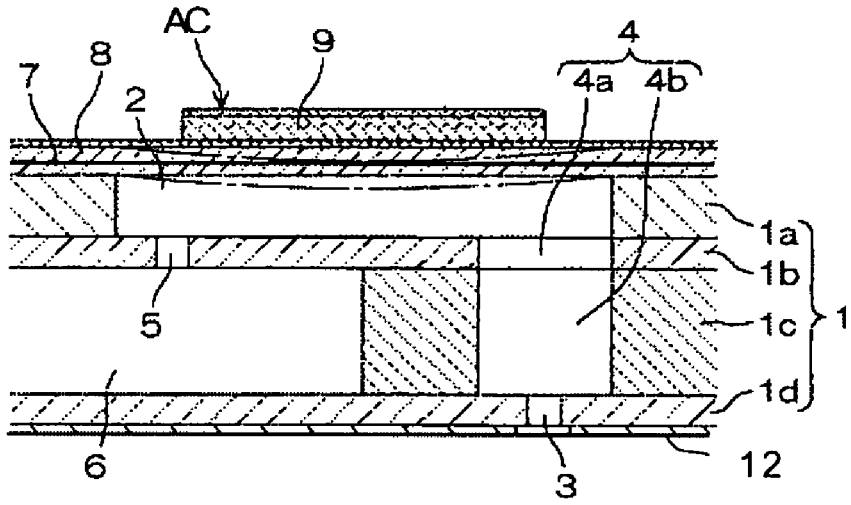
FIG. 2A is a locally enlarged sectional view of the ink jet head according to the present invention.
FIG. 2B is a local bottom view of FIG. 2A.
Figure 2:
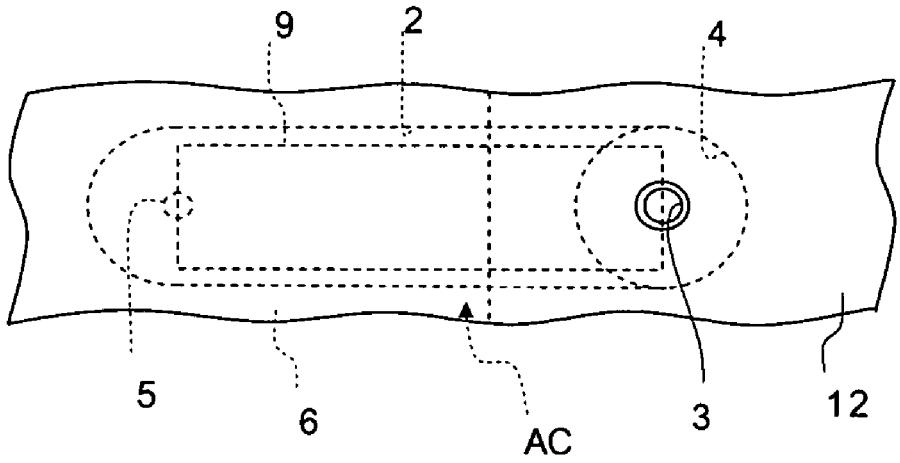
Figure 3:
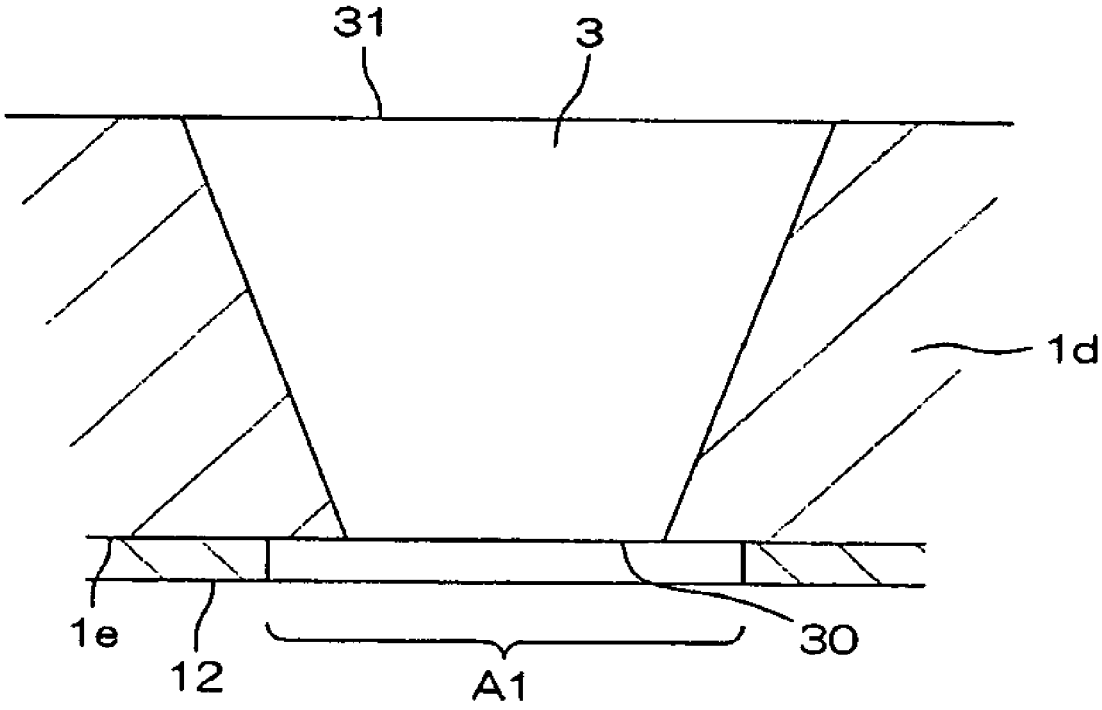
FIG. 3 is an enlarged view of a nozzle part in FIG. 2A.

FIG. 2A is a local sectional view showing in enlarged dimension a dot forming part in a state where a piezoelectric actuator AC is attached to the ink jet head 21 of the above example. FIG. 2B is a bottom view of FIG. 2A. FIG. 3 is an enlarged view of the vicinity of the nozzle 3 in FIG. 2A. A plurality of rows of the nozzles 3 of the dot forming part are arranged in a main scanning direction (a direction of conveyance of a recording medium) as indicated by the white double-headed arrow in FIG. 1. In this example, they are arranged in four rows, and the pitch between the dot forming parts within the row is 150 dpi, thus realizing a total of 600 dpi in the ink jet head 21.

Each dot forming part has a pressurized room 2 in the shape of a flat plate which is formed on the upper surface side of the substrate 1, the nozzle 3 on the lower surface side of the substrate 1, and a nozzle passage 4 for bringing these into communication. The pressurized room 2 is centered at the widthwise center of a rectangular part, and provided with end portions at the longitudinal both ends of the rectangular part, each of which has a diameter equal to the width length and has a semicircular horizontal cross-sectional shape. The pressurized room 2 is communicated with a common passage 6 through a cylindrical supply port 5 which is concentric with the semicircle at the end portion on the other end side of the pressurized room 2. The nozzle 3 is concentric with the semicircle at the end portion on one end side of the pressurized room 2, and has a conic trapezoidal shape. The nozzle passage 4 is concentric with the semicircle at the abovementioned end portion, and has a cylindrical shape of the same diameter. The common passage 6 is formed in the substrate 1 so as to be communicated with the respective dot forming parts. The abovementioned ink passage is made up of at least the common passage 6, the pressurized room 2, and the nozzle passage 4.

In the example of the drawing, the respective parts are integrally formed by stacking, in the order named, a first substrate 1*a* provided with the pressurized rooms 2, a second substrate 1*b* provided with upper parts 4*a* of the nozzle passages 4 and the supply ports 5, a third substrate 1*c* provided with lower parts 4*b* of the nozzle passages 4 and the common passage 6, and a fourth substrate 1*d* provided with the nozzles 3 as a nozzle plate.

In each of the nozzles 3, as shown in FIG. 3, an opening 30 at the tip on the ink drop ejection side is formed in a circle in a surface 1*e* on the lower side of the fourth substrate 1*d* which is the lower surface side of the substrate 1. The nozzle 3 is also formed in a taper shape (in a circular cone shape) so that the opening 30 on the tip side can be smaller than an opening 31 on the pressurized room 2 side.

Each of the first substrate 1*a* and the second substrate 1*b* has a communicating hole 11*a* for configuring the joint part 11, through which the common passage 6 formed in the third substrate 1*c* is connected to the piping from the ink cartridge (not shown) on the upper surface side of the substrate 1, as shown in FIG. 1. The substrates 1*a* to 1*d* are formed of, for example, resin or metal, and are formed by a plate body having a predetermined thickness and communicating holes serving as the respective parts which can be formed by etching using photolithography method, or the like.

The piezoelectric actuator AC is configured on the upper surface side of the substrate 1 by stacking, in the order named, the stacked piezoelectric device 8 in the shape of a plane and a thin plate of transverse vibration mode, and the individual electrodes 9 having the same planar shape in a substantially rectangle. The stacked piezo electric device 8 has substantially the same dimension as the substrate 1, and has in the inside thereof common electrodes 7. The individual electrodes 9 are individually disposed at the position overlapped with the central part of each of the pressurized rooms 2 of the dot forming parts.

The common electrodes 7 and the individual electrodes 9 are formed by using a foil of metal having excellent conductivity such as gold, silver, platinum, copper, or aluminium, or alternatively, a plated coat composed of these metal, or a vacuum deposition coat.

As a piezoelectric material for forming the piezoelectric device 8, there are, for example, PZT piezoelectric materials such as lead zirconium titanate (PZT), and ones obtained by adding, to the PZT, one type or two or more type of oxides of lantern, barium, niobium, zinc, nickel and manganese, such as PLZT. There are also ones mainly composed of lead magnesium niobate (PMN), lead nickel niobate (PNN), lead zinc niobate, lead manganese niobae, lead tin antimonite, lead titanate, or barium titanate.

The piezoelectric device 8 can be formed in the following manner. That is, a chip having a predetermined planar shape, which can be obtained by grinding in a thin plate shape a sintered body formed by sintering for example the abovementioned piezoelectric material, is bonded or fixed to a predetermined position. Specifically, with so-called sol-gel method (or MOD method), a paste formed of an organic metal compound, serving as the base of the piezoelectric material, is printed in a predetermined planar shape, followed by the steps of drying, temporary firing, and firing. As an alternative method of forming the piezo electric device 8, a thin film of a piezo electric material is formed in a predetermined planar shape by vapor phase epitaxial method such as reactive sputtering method, reactive vacuum deposition, or reactive ion plating.

The piezoelectric device 8 can have a desired surface roughness by particle growth acceleration under firing condition, or surface processing using mechanical grinding, etching, and the like. The surface roughness of the piezoelectric device 8 can be measured with, for example, a surface roughness measuring equipment of optical interference type (WykoNT1100, manufactured by Veeco Instrument, Inc.), and evaluated as an average surface roughness Ra.

In order to drive the piezoelectric device 8 as a transverse vibration mode, for example, the polarization direction of a piezoelectric material is oriented in the thickness direction of the piezoelectric device 8, more specifically in the direction from the individual electrodes 9 to the common electrodes 7. This is attainable by employing a well-known polarization method such a high-temperature polarization method, room-temperature polarization method, AC field superposition method, or field cooling method. Alternatively, the piezoelectric device 8 after being polarized may be subject to aging process.

The piezoelectric device 8, in which the polarization direction of the piezoelectric material is oriented in the abovementioned direction, shrinks in a plane orthogonal to the polarization direction, by applying a positive driving voltage from the individual electrodes 9, with the common electrodes 7 grounded. Consequently, the force generated when deflection occurs can be transmitted to the ink within the pressurized rooms 2, as a pressure wave. This pressure wave vibrates the supply ports 5, the pressurized rooms 2, the nozzle passages 4, and the ink within the nozzles 3. The vibrational velocity is finally directed to outside the nozzles 3, so that ink meniscus within the nozzle 3 can be forced to outside from the opening 30 at the tip on the ink drop ejection side, thereby forming ink columns. The vibrational velocity is then directed to the inside of the nozzles 3. On the other hand, the ink columns keep moving outward, and therefore separated from the ink meniscus, and collected as ink drops of about one to two drops. Then, these fly to the direction of a paper surface, thereby forming dots on the paper surface.

By the surface tension of the ink meniscus within the nozzles 3, the decrement of the ink filed as the ink drops can be refilled from the ink cartridge to the nozzles 3 through the piping of the ink cartridge, the joint part 11, the common passage 6, the supply ports 5, the pressurized rooms 2, and the nozzle passages 4.

On the lower surface 1*e* of the fourth substrate 1*d* as the lower surface side of the substrate 1, a region Al not subject to water repellent, having a predetermined planar shape as described above, is overlapped with the circular opening 30 at the tip on the ink ejection side of the nozzles 3. That is, the water repellent processing is carried out with a water repellent layer 12 stacked on the surface 1*e* except for the region A1. The region A1 has no water repellent in which the water repellent layer 12 is not formed and the surface of the fourth substrate 1*d* is exposed.

Although no special limitation is imposed on the thickness of the water repellent layer 12, it is preferably 0.5 to 2 μm. When the thickness of the water repellent layer 12 is below 0.5 μm, there is the likelihood that water repellency is lowered to cause poor ejection of the ink drops due to the adhesion of the ink. It is not easy to form the repellent layer 12 having a thickness exceeding 2 μm, and if it could be formed, it might be difficult to obtain more advantage than that.

The ink jet head 21 of the invention may be driven by driving method of either pull-hit type or push-hit type. In the pull-hit type, the ink meniscus with in the nozzle can be pulled by deforming the piezoelectric device 8 in a direction to expand the capacity of the pressurized rooms 2 immediately before forming dots. Thereafter, ink drops can be separated from the ink meniscus and ejected by deforming the piezoelectric device 8 in a direction to reduce the capacity of the pressurized rooms 2. In the push-hit type, the ink meniscus within the nozzle can be extruded by deforming the piezoelectric device 8 in a direction to reduce the capacity of the pressurized rooms 2 at the time of forming dots. Thereafter, ink drops can be separated from the ink meniscus and ejected by deforming the piezo electric device 8 in a direction to expand the capacity of the pressurized rooms 2.

In the ink jet recording apparatus of the invention, for achieving high-speed print, the ink jet head 21 has 600 or more nozzles, and their driving frequency is preferably 15 kHz or above. Two or more, preferably 2 to 8, more preferably 2 to 4 pieces of the ink jet heads 21 are arranged horizontally in a direction orthogonal to the direction of conveyance of a recording medium. Alternatively, arranging a plurality of the ink jet heads 21 so as to be not less than the width of the recording medium permits the use as a line head.

The ink jet recording method of the invention includes filling the ink passages 4 of the ink jet heads 21 with the introducing liquid, and replacing the introducing liquid within the ink passages 4 with ink, and then ejecting the ink from the nozzles 3 to a surface of a recording medium.

For color printing, the ink can be combined with the abovementioned ink jet head 21 to form a multicolor set, which is normally an ink set including four colors of yellow, magenta, cyan, and black. The ink jet recording apparatus is preferably combined with the ink and the ink jet head 21, together with the ink set.

EXAMPLES

The following examples illustrate the manner in which the present invention can be practiced. It is understood, however, that the examples are for the purpose of illustration and the invention is not to be regarded as limited to any of the specific materials or condition therein.

The physical properties of the introducing liquid were measured in the following manner.

<Surface Tension>

With an automatic surface tension meter ("BP-D4" manufactured by Kyowa Interface Science Co., Ltd.), surface tension measurements according to JIS K 3362 were made at 25° C. to obtain a surface tension A at a lifetime of 10 msec and a surface tension B at a lifetime of 1000 msec, and a difference (A-B) was calculated.

<Contact Angle>

With a contact angle meter ("CA-X type" manufactured by Kyowa Interface Science Co., Ltd.), measurements were made under environment of normal temperature (25° C.) by taking from a syringe 5 μL of introducing liquid drops to be measured, and placing this on the internal surface of an ink supply tube as a component.

<Manufacture of Ink Jet Head>

As an ink jet head 21, there was used one of the type which applies force to the ink by a piezo that induces flexural vibration, can be driven in a frequency of 1 to 40 kHz and a driving voltage of 10 to 30V, and has 400 or more nozzles, employing stainless steel (SUS) as the ink passage member thereof. The ink jet head 21 has the structure as shown in FIG. 1 and FIGS. 2A and 2B, and the dimensions of the respective components were as follows. The pressurized rooms 2 had an area of 0.2 $mm^2$, a width of 200 μm, and a depth of 100 μm. The nozzle passages 4 had a diameter of 200 μm and a length of 800 μm. The supply ports 5 had a diameter of 30 μm and a length of 40 μm. The nozzles 3 had a length of 30 μm. The opening 30 on the ink ejection side and the opening 31 on the pressurized rooms 2 side had a circular shape having 10 μm and 20 μm in radius, respectively. The number of the dot forming parts formed by these components was 166 per row, and the total of the dot forming parts (in four rows) was 664, which were arranged on the substrate 1.

The pitch between the dot forming parts in the row was 150 dpi, and the adjacent rows were shifted in units of ½ pitches, resulting in 600 dpi as a whole.

Examples 1 to 4 and Comparative Examples 1 to 5

After sufficiently mixing and stirring the ingredients in the composition shown in Table 1, this was filtered with a membrane filter of 1.0 μm, thereby obtaining an introducing liquid. In the ingredients shown in Table 1, "EO addition product of acetylene diol" was an addition product obtained by adding 10 mole of ethylene oxide to acetylene diol ("Surfynol®465" manufactured by Air Products and Chemicals, Inc.). In the ingredients shown in Table 1, the organic value (OV) of ethylene glycol monobutyl ether is 120, and the organic value (OV) of triethylene glycol moinobutyl ether is 200. The obtained physical properties of the introducing liquids were as shown in Table 1.

Each of the obtained introducing liquid was loaded into the ink jet head 21. After this was left under environment of 25° C. and 50% RH for one month, an inkcartridge was attached thereto, and ink ("ICC31" manufactured by EPSON CORPORATION) was fed by using a pump, in order to replace the introducing liquid with the ink. The following evaluations were made. The results are shown in Table 1.

Ejection Stability (1): Continuous ejection for 48 hours was carried out at a frequency of 20 kHz and a driving voltage of 20 V. At this time, 10 nozzles were selected at random, and the flight condition of the ink was photographed by a high speed camera. A line was printed and the line was visually observed. The ejection stability thereof was evaluated according to the following criteria.

Symbol "○": 8 m/s or above in ejection velocity, without line breakage;

Symbol "Δ": 8 m/s or above in ejection velocity, with line breakage; and

Symbol "x": Below 8 m/s in ejection velocity.

Ejection Stability (2): Continuous ejection for 48 hours was carried out at a frequency of 20 kHz and a driving voltage of 20 V. At this time, 50 nozzles were selected at random, and the flight condition of the ink was photographed by a high speed camera. A check pattern for ink hit accuracy was printed per hour. The ejection stability thereof was evaluated according to the following criteria.

Symbol "○": 8 m/s or above in ejection velocity, and within ±10 μm in hit accuracy;

Symbol "Δ": 8 m/s or above in ejection velocity, and beyond ±10 μm in hit accuracy; and Symbol "x": Below 8 m/s in ejection velocity, and above ±10 μm in hit accuracy.

Ejection Defects: A nozzle check pattern was printed on glossy paper at a frequency of 20 kHz and a driving voltage of 20 V, and the ejection defects were evaluated according to the following criteria.

Symbol "○": Absence of non-ejection nozzle, and within ±10 μm in hit accuracy;

Symbol "Δ": Absence of non-ejection nozzle, and beyond ±10 μm in hit accuracy; and Symbol "x": Presence of non-ejection nozzle.

TABLE 1

| | Example 1 | Example 2 | Example 3 | Example 4 |
|---|---|---|---|---|
| <Composition(Mass %)> | | | | |
| Glycerin | 15 | 15 | 15 | 15 |
| 2-Pyrrolidone | 5 | 5 | 5 | 5 |
| EO addition product of acetylene diol | 1 | 1 | 1 | 1 |
| Propylene glycol | — | — | — | — |
| Hexylene glycol | 5 | — | 10 | — |

TABLE 1-continued

| | | | | |
|---|---|---|---|---|
| Ethylene glycol monobutyl ether | — | — | — | — |
| Triethylene glycol moinobutyl ether | — | 5 | — | 10 |
| Water | R*2) | R | R | R |
| Total | 100 | 100 | 100 | 100 |
| <Surface tension> | | | | |
| $(St_{10}-St_{1000})$*1) (mN/m) | 15 | 11 | 9 | 7 |
| <Contact angle> | | | | |
| Contact angle with respect to SUS(Degrees) | 19 | 17 | 15 | 12 |
| <Evaluation> | | | | |
| Ejection stability (1) | ○ | Δ | ○ | ○ |
| Ejection stability (2) | Δ | ○ | ○ | ○ |
| Ejection Defects | Δ | ○ | ○ | ○ |

| | Comparative example 1 | Comparative example 2 | Comparative example 3 | Comparative example 4 | Comparative example 5 |
|---|---|---|---|---|---|
| <Composition(Mass %)> | | | | | |
| Glycerin | 15 | 15 | 15 | 15 | — |
| 2-Pyrrolidone | 5 | 5 | 5 | 5 | — |
| EO addition product of acetylene diol | 1 | 1 | 1 | — | — |
| Propylene glycol | — | 5 | — | — | — |
| Hexylene glycol | — | — | — | — | — |
| Ethylene glycol monobutyl ether | — | — | 5 | — | — |
| Triethylene glycol moinobutyl ether | — | — | — | 10 | 10 |
| Water | R*2) | R | R | R | R |
| Total | 100 | 100 | 100 | 100 | 100 |
| <Surface tension> | | | | | |
| $(St_{10}-St_{1000})$*1) (mN/m) | 18 | 17 | 16 | 0 | 0 |
| <Contact angle> | | | | | |
| Contact angle with respect to SUS(Degrees) | 32 | 25 | 21 | — | — |
| <Evaluation> | | | | | |
| Ejection stability (1) | x | x | ○ | x | x |
| Ejection stability (2) | x | x | Δ | x | x |
| Ejection Defects | x | Δ | x | x | x |

*1)$St_{10}$: Surface tension at a lifetime of 10 msec, $St_{1000}$: Surface tension at a lifetime of 1000 msec.
*2)R: Amount of the remainder As shown in Table 1, Examples 1 to 4, whose surface tension and contact angle of the introducing liquid were within the scope of the present invention, had good ejection stability and had neither non-ejection nozzle nor ejection defects. On the other hand, Comparative Examples 1 to 5, whose surface tension and contact angle of the introducing liquid were beyond the scope of the present invention, had poor ejection stability or non-ejection nozzle.

It is further understood by those skilled in the art that the foregoing description is a preferred embodiment of the disclosed introducing liquid and that various changes and modifications may be made in the invention without departing from the spirit and scope thereof.

What is claimed is:

1. An introducing liquid for an ink jet head which is used to fill the ink jet head before introducing ink into the ink jet head, the introducing liquid having a surface tension satisfying the following equation (1), and a contact angle of not more than 25 degrees with respect to an ink passage member of the ink jet head to be applied, $$6\text{mN/m}<(St_{10}-St_{1000})<16\text{mN/m} \quad (1)$$

where $St_{10}$ is a surface tension in a lifetime of 10 msec, and $St_{1000}$ is a surface tension in a lifetime of 1000 msec.

2. The introducing liquid for an ink jet head according to claim 1, the introducing liquid comprises water, a surface active agent, and a water-soluble organic solvent, the water-soluble organic solvent containing at least one selected from diols having a carbon number of 6 to 8, and polyhydric alcohol alkyl ethers having an organic value (OV) of not less than 150.

3. The introducing liquid for an ink jet head according to claim 2, wherein the water- soluble organic solvent has a content of 0.1 to 35 weight % to a total weight of the introducing liquid.

4. The introducing liquid for an ink jet head according to claim 1, the ink passage member is formed of at least one selected from the group consisting of epoxy resin, stainless steel, nickel alloy, polyimide resin, polycarbonate resin, and silicone resin.

5. The introducing liquid for an ink jet according to claim 2, wherein the polyhydric alcohol alkyl ethers is at least one of diethylene glycol monobutyl ether, triethylene glycol monobutyl ether, diplopylene glycol monobutyl ether, and triplopylene glycol monobutyl ether.

* * * * *